US010679470B2

(12) United States Patent
Jones et al.

(10) Patent No.: US 10,679,470 B2
(45) Date of Patent: Jun. 9, 2020

(54) ITEM CAROUSEL SYSTEM

(71) Applicant: Walmart Apollo, LLC, Bentonville, AR (US)

(72) Inventors: Nicholaus Adam Jones, Fayetteville, AR (US); Aaron Vasgaard, Fayetteville, AR (US); Matthew Allen Jones, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/913,359

(22) Filed: Mar. 6, 2018

(65) Prior Publication Data

US 2018/0268664 A1 Sep. 20, 2018

Related U.S. Application Data

(60) Provisional application No. 62/472,327, filed on Mar. 16, 2017.

(51) Int. Cl.
*G07G 1/00* (2006.01)
*A47F 9/04* (2006.01)

(52) U.S. Cl.
CPC ..... *G07G 1/0009* (2013.01); *A47F 9/042* (2013.01); *A47F 9/043* (2013.01); *G07G 1/0018* (2013.01); *G07G 1/0045* (2013.01)

(58) Field of Classification Search
CPC .... A47F 9/00; A47F 9/04; A47F 9/042; A47F 9/043; A47F 9/047; A47F 9/02; A47F 9/046–9/048; A47F 2009/041; A47F 2009/044; A47F 13/08; A47F 13/085; G06Q 20/20; G06Q 20/208; G07G 1/0009; G07G 1/0018; G07G 1/0036; G07G 1/0045; G07G 1/0054; G07G 1/01
See application file for complete search history.

(56) References Cited

U.S. PATENT DOCUMENTS 5,083,638 A * 1/1992 Schneider ..... A47F 9/048 177/25.15
5,551,531 A * 9/1996 Dumont ..... A47F 9/042 186/61
6,955,029 B2 10/2005 Palumbo
(Continued)

*Primary Examiner* — Thien M Le
*Assistant Examiner* — April A Taylor
(74) *Attorney, Agent, or Firm* — McCarter & English, LLP; David R. Burns

(57) ABSTRACT

An example item carousel system is described. The system includes a terminal including a processor and a scanner. The system includes a carousel rotatably mounted to the terminal, the carousel including two or more bagging sections configured to receive bags. The system includes a motorized actuator configured to actuate rotation of the carousel relative to the terminal. The terminal is configured to read data from a machine readable identifier associated with an item using the scanner, and retrieve, using a retrieval module, item characteristics associated with the item from an item database. The terminal is configured to identify one bagging section of the two or more bagging sections of the carousel capable of receiving the item with the item characteristics, and mechanically rotate the carousel relative to the terminal with the motorized actuator such that the identified one bagging section is oriented toward a bagging area of the terminal.

26 Claims, 6 Drawing Sheets

(56) References Cited

U.S. PATENT DOCUMENTS

| | | | | |
|---|---|---|---|---|
| 7,407,089 | B2 | 8/2008 | Patrick | |
| 7,575,162 | B1 | 8/2009 | Malchak et al. | |
| 7,578,440 | B2 | 8/2009 | Ulrich et al. | |
| 7,648,066 | B2 | 1/2010 | Kangas et al. | |
| 7,866,546 | B1 * | 1/2011 | Vance | G07G 1/14 235/379 |
| 8,584,805 | B2 | 11/2013 | Nelson et al. | |
| 9,101,232 | B1 * | 8/2015 | Newman | A47F 9/04 |
| 9,433,307 | B1 * | 9/2016 | Newman | A47F 9/042 |
| 2005/0114216 | A1 * | 5/2005 | Lantz | A47F 9/045 705/16 |
| 2008/0054071 | A1 * | 3/2008 | Kangas | A47F 9/047 235/383 |
| 2008/0121702 | A1 * | 5/2008 | Fortenberry | G01G 19/4144 235/383 |
| 2009/0090584 | A1 | 4/2009 | Chakra et al. | |
| 2012/0187194 | A1 * | 7/2012 | Svetal | G07G 1/0045 235/470 |
| 2013/0144429 | A1 * | 6/2013 | Ragusa | B07C 3/00 700/224 |
| 2013/0254044 | A1 * | 9/2013 | Catoe | G06Q 20/20 705/16 |
| 2015/0114798 | A1 * | 4/2015 | Panunto | B07C 7/04 198/418.4 |
| 2015/0142604 | A1 | 5/2015 | Kneen | |
| 2017/0174440 | A1 * | 6/2017 | Ripley | B07C 5/3412 |
| 2018/0049565 | A1 * | 2/2018 | Bacallao | A47F 9/048 |
| 2018/0222620 | A1 * | 8/2018 | Lewis | B65B 57/14 |

* cited by examiner

ITEM CAROUSEL SYSTEM

CROSS-REFERENCE TO RELATED APPLICATIONS

This application claims the benefit of commonly assigned U.S. Provisional Patent Application No. 62/472,327, which was filed on Mar. 16, 2017. The entire content of the foregoing provisional patent application is incorporated herein by reference.

BACKGROUND

Items are sorted during bagging at a terminal for various reasons and tasks. Manual sorting of items is prone to inconsistencies and is a slow process.

SUMMARY

Exemplary embodiments of the present disclosure provide an item carousel system that automatically identifies which bagging section of a carousel should receive a scanned item based on characteristics associated with the scanned item. The item carousel system includes a motorized actuator that rotates the carousel after an item is scanned to orient a bagging section of the carousel toward a bagging area or bagging associate. The item carousel system can include visual indicators on the bagging sections or disposed above the bagging sections and configured to illuminate a particular bagging section, such that visual identification of a selected bagging section can be provided. The item carousel system can receive, as input user, preferences for bagging items such that the user preferences are taken into account when selecting a bagging section. The automatic and substantially real-time dynamic identification of a bagging section that should receive scanned item, as well as automated rotation of the carousel to appropriately orient the selected bagging section, ensures an accurate and efficient bagging process.

In accordance with embodiments of the present disclosure, an exemplary item carousel system is provided. The item carousel system includes a terminal including a processor and a scanner. The item carousel system includes a carousel rotatably mounted to the terminal. The carousel includes two or more bagging sections, each bagging section configured to receive bags. The item carousel system includes a motorized actuator configured to actuate rotation of the carousel relative to the terminal. The terminal is configured to read data from a machine readable identifier associated with an item using the scanner. The terminal is configured to retrieve, using a retrieval module, item characteristics associated with the item from an item database. The terminal is configured to identify one bagging section of the two or more bagging sections of the carousel capable of or dynamically designated for receiving the item with the item characteristics. The terminal is configured to mechanically rotate the carousel relative to the terminal with the motorized actuator such that the identified one bagging section is rotated to be oriented toward a bagging area of the terminal, e.g., after an item is scanned and before the item is placed in the bagging section.

In some embodiments, the item carousel system can include a graphical user interface configured to receive as input preferences from a user regarding bagging of items at the carousel. The item carousel system can include a preference database storing the preferences input by the user. In some embodiments, the preferences include at least one of item compliance, bag weight limit, or bag type. The terminal can be configured to retrieve, using the retrieval module, the preferences from the preference database, and identify the one bagging section of the two or more bagging sections of the carousel capable of or dynamically designated for receiving the item with the item characteristics and meeting the preferences from the preference database.

In some embodiments, the item carousel system can include one or more visual indicators configured to identify the one bagging section of the two or more bagging sections of the carousel capable of or dynamically designated for receiving the item with the item characteristics. In one embodiment, the one or more visual indicators can each include a light emitting diode disposed above the carousel and configured to illuminate at least a portion of the identified one bagging section. In one embodiment, the one or more visual indicators can include light emitting diodes disposed at each bagging section of the carousel. After identification of the one bagging section capable of receiving the item, the terminal can be configured to transmit a signal to an electric circuit to illuminate the light emitting diodes disposed at the identified one bagging section.

In some embodiments, the item carousel system can include a sensor configured to detect items stored within the bags at the two or more bagging sections. In some embodiments, the item carousel system can include one or more cameras configured to detect and identify items stored within the bags at the two or more bagging sections. In some embodiments, the item carousel system can include a sensor at each bagging section configured to detect a total weight of items within each bag.

In accordance with embodiments of the present disclosure, an exemplary method of bagging items is provided. The method includes providing an item carousel system including a terminal including a processor and a scanner. The item carousel system includes a carousel rotatably mounted to the terminal, the carousel including two or more bagging sections, each bagging section configured to receive bags. The item carousel system includes a motorized actuator configured to actuate rotation of the carousel relative to the terminal. The method includes reading data from a machine readable identifier associated with an item using the scanner. The method includes retrieving, using a retrieval module, item characteristics associated with the item from an item database. The method includes identifying one bagging section of the two or more bagging sections of the carousel capable of or dynamically designated for receiving the item with the item characteristics. The method includes mechanically rotating the carousel relative to the terminal with the motorized actuator such that the identified one bagging section is oriented toward a bagging area of the terminal, e.g., after an item is scanned and before the item is placed in the bagging section.

In some embodiments, the method can include receiving as input preferences from a user via a graphical user interface regarding bagging of items at the carousel, and storing the preferences input by the user in a preference database. In some embodiments, the method can include retrieving, using the retrieval module, the preferences from the preference database, and identifying the one bagging section of the two or more bagging sections of the carousel capable of or dynamically designated for receiving the item with the item characteristics and meeting the preferences from the preference database.

In some embodiments, the method can include identifying the one bagging section of the two or more bagging sections of the carousel capable of or dynamically designated for receiving the item with the item characteristics with one or more visual indicators. In some embodiments, identifying the one bagging section with the one or more visual indicators can include illuminating at least a portion of the identified one bagging section with a light emitting diode disposed above the carousel. In some embodiments, the carousel can include light emitting diodes disposed at each bagging section. In some embodiments, identifying the one bagging section with the one or more visual indicators can include illuminating a light emitting diode disposed at the identified one bagging section.

In some embodiments, the method can include detecting items stored within the bags at the two or more bagging sections with a sensor. In some embodiments, the method can include detecting and identifying items stored within the bags at the two or more bagging sections with one or more cameras. In some embodiments, the method can include detecting a total weight of items within each bag with a sensor at each bagging section.

In accordance with embodiments of the present disclosure, an exemplary non-transitory computer-readable medium storing instructions for operating an item carousel system that are executable by a processor is provided. The item carousel system includes a terminal including the processor and a scanner. The item carousel system includes a carousel rotatably mounted to the terminal, the carousel including two or more bagging sections, each bagging section configured to receive bags. The item carousel system includes a motorized actuator configured to actuate rotation of the carousel relative to the terminal. Execution of the instructions by the processor causes the processor to read data from a machine readable identifier associated with an item using the scanner. Execution of the instructions by the processor causes the processor to retrieve, using a retrieval module, item characteristics associated with the item from an item database. Execution of the instructions by the processor causes the processor to identify one bagging section of the two or more bagging sections of the carousel capable of or dynamically designated for receiving the item with the item characteristics. Execution of the instructions by the processor causes the processor to mechanically rotate the carousel relative to the terminal with the motorized actuator such that the identified one bagging section is oriented toward a bagging area of the terminal, e.g., after an item is scanned and before the item is placed in the bagging section.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the item carousel system, reference is made to the accompanying figures, wherein.

DETAILED DESCRIPTION

Exemplary embodiments of the present disclosure provide an item carousel system that automatically (and dynamically) identifies which bagging section of a carousel should receive a scanned item, and rotates the carousel in an automated manner to orient the selected bagging section toward a bagging area or bagging associate. The item carousel system can identify the bagging section into which the item should be placed based on characteristics associated with the scanned item and/or bagging preferences input by a user. The item carousel system includes a motorized actuator that rotates the carousel after the item is scanned in a substantially real-time manner. The item carousel system can include visual indicators for simultaneously indicating which bagging section should be used to bag an item. The visual indicators can be disposed on each of the bagging sections or can be disposed above the bagging sections and configured to illuminate a particular bagging section, such that visual identification of a selected bagging section can be provided. The automatic and substantially real-time identification of a bagging section that should receive scanned item, as well as automated rotation of the carousel to appropriately orient the selected bagging section, ensures an accurate and efficient bagging process.

Figure 1:
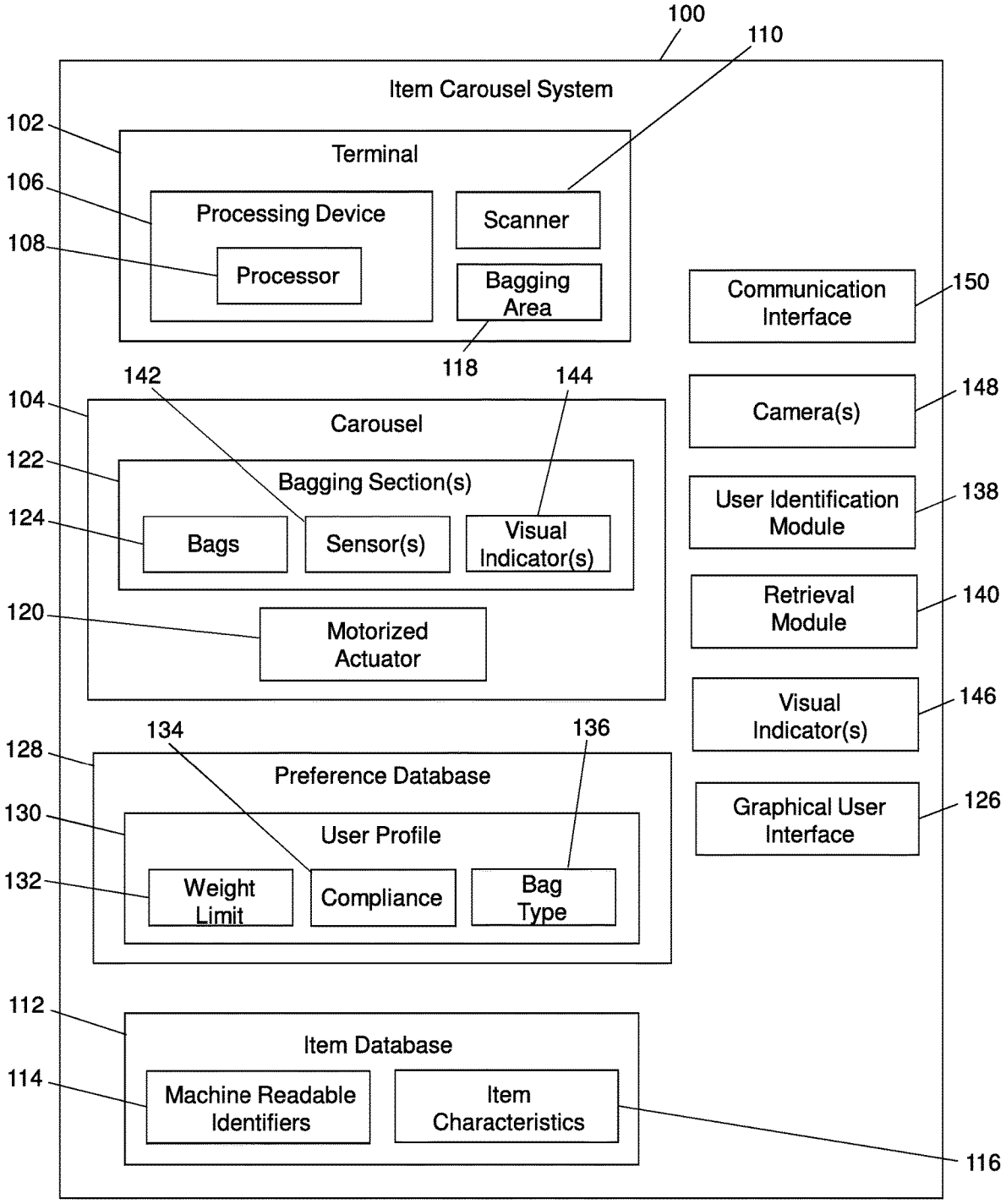
FIG. 1 is a block diagram of an exemplary item carousel system of the present disclosure.

FIG. 1 is a block diagram of an exemplary item carousel system 100 (hereinafter "system 100") of the present disclosure. The system 100 includes one or more terminals 102 with a carousel 104 associated with each terminal 102. Each terminal 102 includes a processing device 106 with a processor 108. Each terminal 102 includes a scanner 110 (e.g., an optical scanner) configured to read data from the machine readable identifiers (e.g., barcodes, linear barcodes, Quick Response (QR) codes, two-dimensional barcodes, matrix barcodes, radio-frequency identification (RFID) tags, and the like) associated with items procured at the terminal 102. Any number of items can be available for procurement at the terminal 102 in an establishment. The system 100 includes an item database 112 in communication with the terminal 102 and electronically storing data associated with the items, such as the machine readable identifiers 114 and item characteristics 116, e.g., weight, size, category (beauty, personal care, pharmacy, electronics, office, movies, music, books, home improvement, furniture, patio furniture, toys, video games, frozen food, warm food, raw food, fresh produce, household supplies, cleaning products, pet, photo, or gifts) or the like. Each terminal 102 includes a bagging area 118 (e.g., a user-facing area) disposed at or near the carousel 104 such that the procured items can be placed in bags for transport out of the establishment.

The carousel 104 is rotatably mounted relative to the terminal 102. The carousel includes a motorized actuator 120 that can be electronically regulated by the terminal 102 to rotate the carousel 104 relative to the terminal 102 about an axis (e.g., a central axis). The carousel 104 includes two or more bagging sections 122 with each bagging section 122 including bags 124 for receiving one or more items procured at the terminal 102. In some embodiments, the bags 124 can hang on support flanges at each of the bagging sections 122 to facilitate convenient bagging of the procured items.

The system 100 can include a graphical user interface (GUI) 126 at or near the terminal 102 such that data can be input into the system 100. In some embodiments, the GUI 126 can be operated by a user (e.g., a customer, an associate, or the like) to input data into the system 100 in order to create or recall a user profile with bagging preferences. For example, the system 100 can include a preference database 128 electronically storing data associated with multiple user profiles 130. Each user profile 130 can include data corresponding with bagging preferences of the user, such as a weight limit 132, compliance 134, and bag type 136.

Some user preferences can include temperature interspersion (e.g., refrigerated and frozen items in the same bar, no preference regarding how refrigerated and frozen items are bagged, or the like), different categories of items to be grouped together or separately (e.g., baking items in one bag, fresh produce in a separate bag, or the like), material of the items to be grouped together or separately (e.g., cans together, boxes together, bags together, or the like), and quickness or speed of bagging. Some user preferences can include the order in which items are placed into bags and/or which items can be group together in a bag (or cannot be grouped together in a bag). In some embodiments, the system 100 can monitor the order in which a user places items into bags or the group of items in a bag (e.g., via sensors and/or cameras) to determine and store the preferred order or groups of bagging.

The weight limit 132 corresponds to the maximum weight of each bag 124 containing one or more items. For example, older users may wish to limit the weight of each bag 124 for ease of transport of the items. Compliance 134 corresponds to separation or grouping of certain items. For example, a user may wish for raw items to be bagged separately from fresh items. As a further example, a user may wish for canned goods to be bagged together. As a further example, a user may wish for frozen items to be bagged together. Bag type 136 corresponds with the type of bag 124 (e.g., paper, plastic, insulated, or the like) and/or whether the user wishes to have items double-bagged. In some embodiments, the user may wish to reduce the total bag count by placing as many items as possible into each bag 124 (without surpassing the weight capacity of each bag 124).

In some embodiments, prior to procurement of items at the terminal 102, the user can input via the GUI 126 unique identifying information (e.g., a telephone number) to identify the specific user. A user identification module 138 can be executed by the processing device 106 to receive as input the user identifying information and output the corresponding user profile 130 such that the appropriate user preferences can be used for bagging the items procured at the terminal 102. In some embodiments, if the user does not have a user profile 130 or does not have bagging preferences, the system 100 can operate based on a standard bagging operation programmed into the system 100 (e.g., bagging raw and fresh items separately, bagging canned items together, bagging fruit together, bagging frozen or cold items together, bagging warm items together, or the like).

During procurement of items at the terminal 102, the machine readable identifier 114 of each item is read by the scanner 110. Upon reading the machine readable identifier 114, the processing device 106 executes a retrieval module 140 to receive as input the machine readable identifier 114, identify the specific item scanned, and retrieve or output the item characteristics 116 associated with the scanned item. Based on the identified item, the processing device 106 identifies which bagging sections 122 of the carousel 104 are capable of or dynamically designated for receiving the item with the identified item characteristics 116.

For example, if none of the bagging sections 122 are used, the processing device 106 identifies all of the bagging sections 122 as capable of receiving the scanned item. If more than one bagging section 122 is identified as capable of receiving the item, the processing device 106 selects one of the identified bagging sections 122 for bagging of the item (either randomly or the bagging section 122 closest to the bagging area 118). As one example, upon scanning an item, the terminal 102 can determine if there is more than one bagging section 122 that has not received any items, and the terminal 102 can designate one of these (unused) bagging sections 122 to receive the scanned item. As another example, the terminal 102 can determine that the scanned item can be received by more than one of the bagging sections 122 because the bagging sections 122 have yet to receive an item and/or because at least one of the bagging sections 122 have previously been designated to receive the scanned item (e.g., based on the user profile and/or item characteristics). If only one of the bagging sections 122 is capable of receiving the item, the processing device 106 identifies the single bagging section 122 as the bagging section 122 to be used.

Upon identification of the bagging section 122 to be used, the processing device 106 actuates the motorized actuator 120 to rotate the mechanically rotate the carousel 104 such that the identified or selected bagging section 122 is oriented toward the bagging area 118 of the terminal 102. Thus, the system 100 automatically identifies which bagging section 122 should be used for the item and orients the carousel 104 appropriately, e.g., after the item is scanned and before the item is placed in the identified bagging section 122. In some embodiments, the processing device 106 can regulate the speed at which the carousel 104 is rotated by the motorized actuator 120 (e.g., motor) such that the selected bagging section 122 is rotated into the desired position before the item reaches the carousel 104 via a conveyor belt associated with the terminal 102. If the processing device 106 determines that none of the bagging sections 122 are capable of receiving the item due to incompatibilities with items already in the bagging sections 122 (e.g., weights of the bags in the bagging sections 122 exceed the specified weight limit or the item cannot be grouped with any of the items in any of the bags in the bagging sections 122), the processing device 106 can output an alert via the GUI 126 (e.g., a visual alert and/or an audio alert) indicating that one of the bags 124 should be removed from the bagging sections 122.

In some embodiments, the bagging section 122 selected for bagging the scanned item can be based on general bagging practices programmed into the system 100. In some embodiments, the bagging section 122 selected for bagging the scanned item can be based on the preferences of the user as stored and retrieved from the user profile 130. In particular, the selected bagging section 122 must be capable of receiving an item with the item characteristics 116 and must meet the preferences from the preference database 128. The terminal 102 can determine that a particularly bagging section 122 is not capable of receiving an item based on one or more items previously received by the particular bagging section 122. The terminal 102 can dynamically designate bagging sections 122 for scanned items as the items are scanned such that bagging sections 122 do not have predefined or static designations and/or can dynamically assign the items to bagging sections 122 as the items are scanned such that the scanned items are not preassigned to a particular bagging section 122.

In some embodiments, each of the bagging sections 122 can include one or more sensors 142 configured to detect the total weight of items within each bag 124. Thus, based on the standard bagging instructions or the weight limit 132 in the user profile 130, when the total weight of the items within a bag 124 is achieved or the bag 124 is no longer capable of receiving items without exceeding the weight limit 132, the processing device 106 can output an alert via the GUI 126 (e.g., a visual alert and/or an audio alert) indicating that the bag 126 should be removed from the carousel 104. The processing device 106 can regulate the motorized actuator 120 to rotate the carousel 104 such that the bagging section 122 having the bag 124 to be removed faces the bagging area 118, thereby clearly identifying which bag 124 should be removed.

In some embodiments, the sensors 142 can be configured to detect which items are stored within the individual bags 124 in the bagging sections 122. The system 100 can thereby keep track of whether the proper items have been bagged together. If the system 100 detects that improper items have been bagged together, an alert can be output via the GUI 126 and the carousel 104 can be rotated to face the bagging area 118 to allow the improperly bagged items to be removed and placed in the appropriate bag 124.

In some embodiments, the system 100 can include one or more cameras 148 (e.g., optical eyes) disposed at and/or around the carousel 104. The cameras 148 can be configured to capture images of the bagging sections 122 and, based on image and/or video analytics, identify the items stored within the bags 124 at each bagging section 122. Based on such detection, if improper items have been bagged together, an alert can be output via the GUI 126 and the carousel 104 can be rotated to face the bagging area 118 to allow the improperly bagged items to be removed and placed in the appropriate bag 124. The cameras 148 can also correlate the data received from the item scanned with the detected item placed into a bag 124 to confirm that the scanned item matches the bagged item.

In some embodiments, the system 100 can keep track of which items have been bagged together (e.g., which items have been grouped in which bagging section 122) as the terminal 102 scans the items. Using this information, the terminal 102 can determine the weights of each of the bags in the bagging sections 122 based on item weight parameters in the item characteristics which can be retrieved from the items database when the items are scanned.

In some embodiments, in addition to the automatic and motorized rotation of the carousel 104, the system 100 can include one or more visual indicators 144, 146 for identifying the bagging section 122 of the carousel 104 capable of receiving the scanned item. In one embodiment, the visual indicators 144 can include light emitting diodes (LEDs) disposed at each bagging section 122. An electric circuit can be operatively coupled to the terminal 102 and each of the visual indicators 144. In such embodiments, upon identifying which bagging section 122 is capable of or designated for receiving the scanned item, the processing device 106 can transmit a signal to the electric circuit to illuminate the LED disposed at the identified bagging section 122, thereby providing a visual indication of the bag 124 in which the item should be placed. This action can occur simultaneously to rotation of the carousel 104.

In one embodiment, the visual indicators 146 can include one or more LEDs disposed above the carousel (e.g., secured to the ceiling) and configured to illuminate at least a portion of the identified bagging section 122. An electric circuit can be operatively coupled to the terminal 102 and each of the visual indicators 146. In such embodiments, upon identifying which bagging section 122 is capable of receiving the scanned item, the processing device 106 can transmit a signal to the electric circuit to illuminate the LED directed at the selected bagging section 122. This action can occur simultaneously to rotation of the carousel 104. In some embodiments, the illuminated LED can be configured to follow the selected bagging section 122 as the carousel 104 rotates. In some embodiments, after procurement and bagging of all items, the system 100 can receive as input feedback from the user regarding the bagging process via the GUI 126, thereby allowing the system 100 to adjust the user preferences based on the feedback. In some embodiments, the system 100 can include a communication interface 150 that provides a network over which components of the system 100 can transmit and receive data, thereby communicating amongst themselves.

Figure 2:
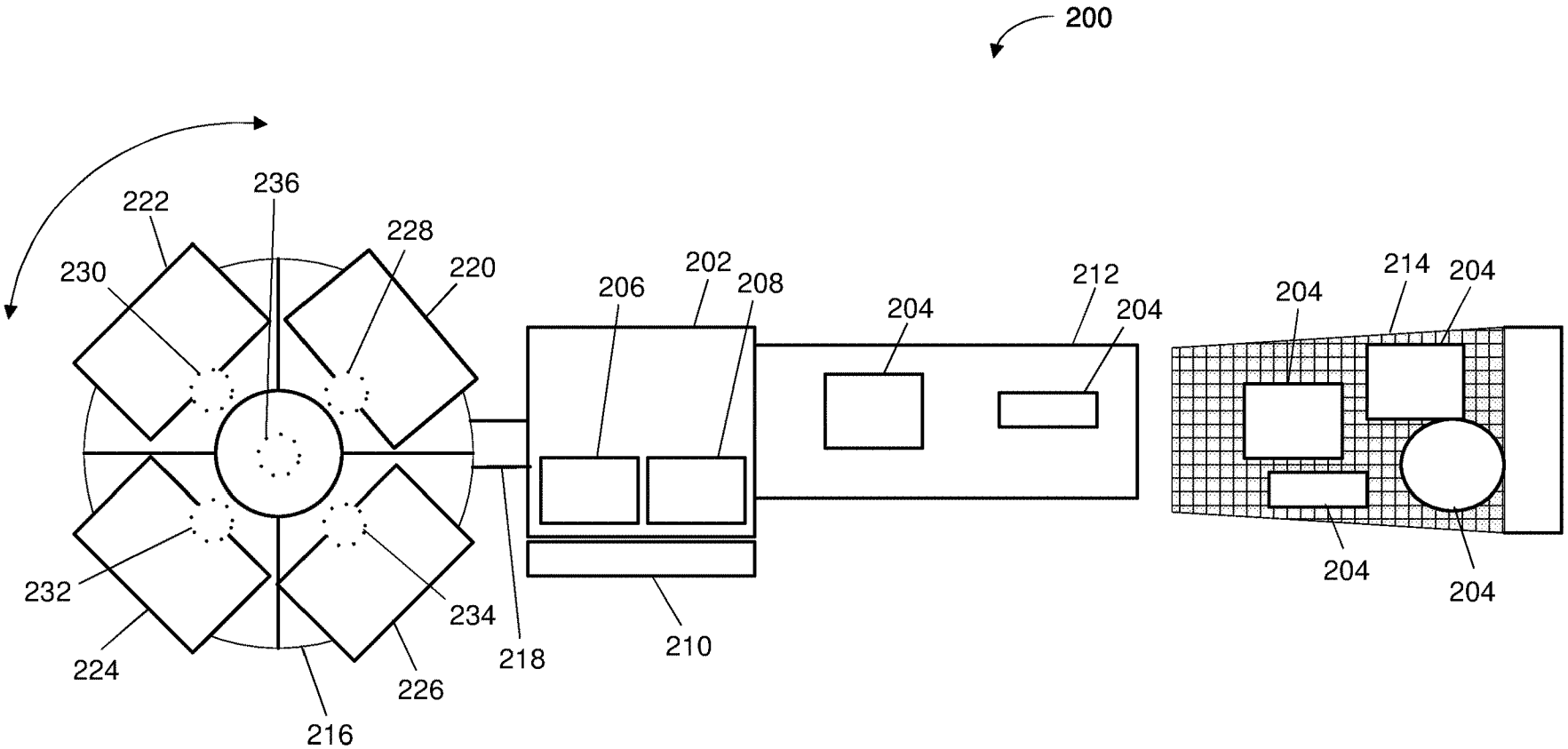
FIG. 2 is a diagrammatic view of an exemplary item carousel system of the present disclosure.

FIG. 2 is a diagrammatic view of an exemplary item carousel system 200 (hereinafter "system 200"). The system 200 includes a terminal 202 for procuring one or more items 204 from an establishment. The terminal 202 includes a processing 206 and a scanner 208. The processor 206 may be an optical scanner for scanning machine readable identifiers or machine readable optical labels associated with the items 204. The terminal 202 can include a graphical user interface 210 for input/output of data. The system 200 can include a conveyor belt 212 configured to guide the items 204 towards the terminal 202. Multiple items 204 can therefore be brought to the system 200 via a shopping cart 214 and transferred to the conveyor belt 212 for transfer to the terminal 202.

The system 200 includes a carousel 216 operatively or electrically coupled to the terminal 202 via an electric circuit 218 (e.g., a programmable logic circuit). The carousel 218 includes separate bagging sections 220-226 (e.g., radially separated bagging sections). Although four bagging sections 220-226 are shown, it should be understood that the carousel 216 can include fewer or more than four bagging sections (e.g., more than two bagging sections). Each bagging section 220-226 includes bags or totes to hold the items 204 after they have been scanned at the terminal 202. In some embodiments, each bagging section 220-226 can include a visual indicator 228-234 (e.g., an LED) operatively or electrically coupled to the terminal 202 via the electric circuit 218. The carousel 216 includes a motorized actuator 236 (e.g., a motor) operatively or electrically coupled to the terminal 202 via the electric circuit 218.

As described above, as each item 204 is scanned at the terminal 202, item characteristics are retrieved from an item database to determine which bagging sections 220-226 are capable of receiving the item 204. Based on user preferences and the items 204 already placed in the bagging sections 220-226, the processor 206 identifies or selects one bagging section 220-226 that will receive the scanned item 204. Based on this identification or selection, the processor 206 communicates with the motorized actuator 236 via the electric circuit 218 to rotate the carousel 216 such that the selected bagging section 220-226 faces the bagging area. In some embodiments, the bagging area can be the area nearest the associate operating the terminal 202 (e.g., the position of the bagging section 220). Thus, if the bagging section 224 is selected as the one to receive the scanned item 204, the carousel 216 can be rotated to reposition the bagging section 224 in the position of the bagging section 220, thereby providing a clear indication to the associate which bagging section 220-226 should receive the item 204. In some embodiments, in addition to rotating the carousel 216, the visual indicator 228-234 corresponding with the selecting bagging section 220-226 can be illuminated via instructions transmitted through the electric circuit 218. In some embodiments, the selected bagging section 220-226 can be illuminated with an LED disposed above the carousel 216 to identify the selected bagging section 220-226.

Figure 3:
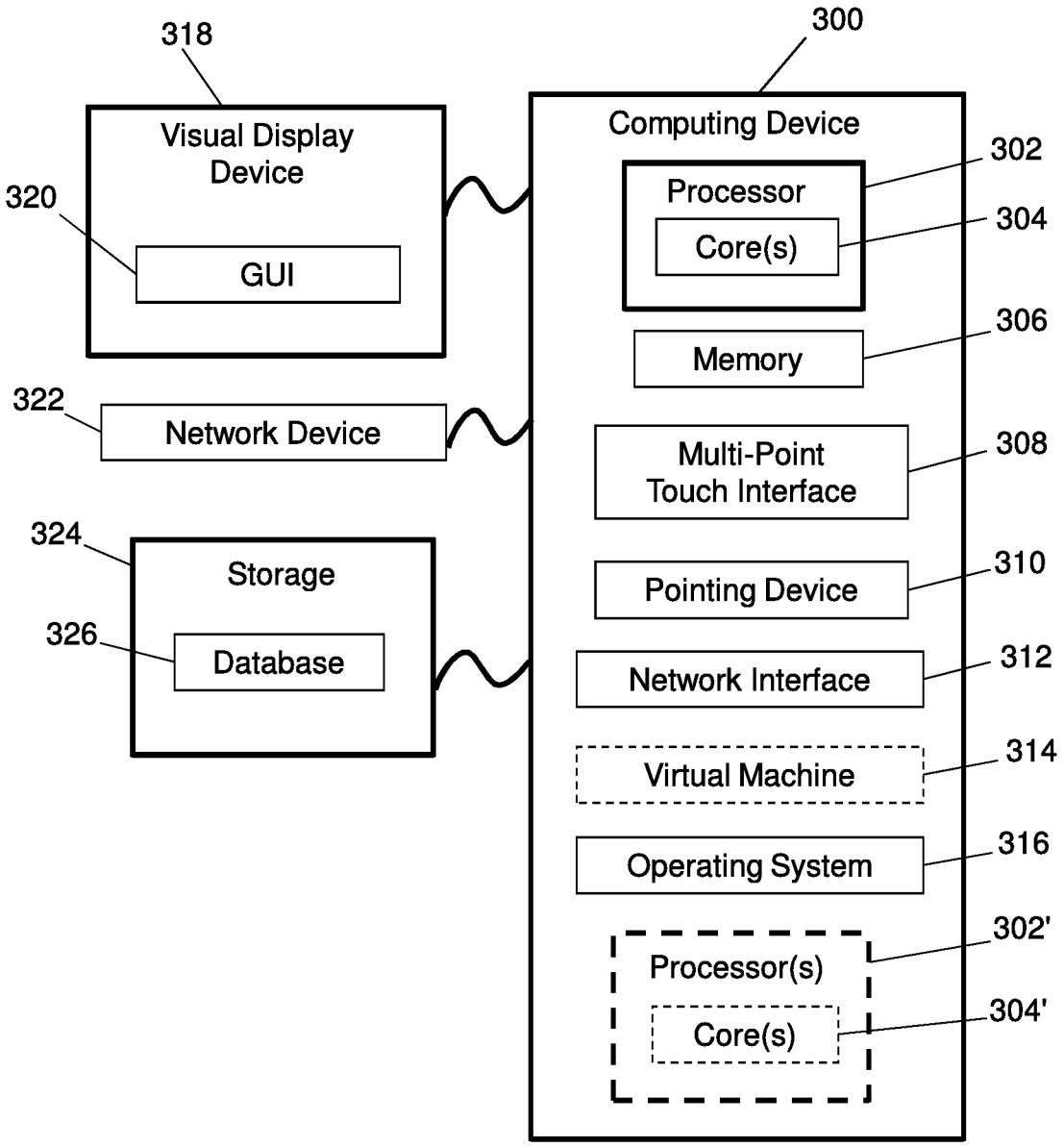
FIG. 3 is a block diagram of a computing device in accordance with exemplary embodiments of the present disclosure.

FIG. 3 is a block diagram of a computing device 300 in accordance with exemplary embodiments of the present disclosure. The computing device 300 includes one or more non-transitory computer-readable media for storing one or more computer-executable instructions or software for implementing exemplary embodiments. The non-transitory computer-readable media may include, but are not limited to, one or more types of hardware memory, non-transitory tangible media (for example, one or more magnetic storage disks, one or more optical disks, one or more flash drives), and the like. For example, memory 306 included in the computing device 300 may store computer-readable and computer-executable instructions or software for implementing exemplary embodiments of the present disclosure (e.g., instructions for operating the terminal 102, instructions for operating the motorized actuator 120, instructions for operating the sensors 142, instructions for operating the visual indicators 144, 146, instructions for operating the cameras 148, combinations thereof, or the like). The computing device 300 also includes configurable and/or programmable processor 302 and associated core 304, and optionally, one or more additional configurable and/or programmable processor(s) 302' and associated core(s) 304' (for example, in the case of computer systems having multiple processors/cores), for executing computer-readable and computer-executable instructions or software stored in the memory 306 and other programs for controlling system hardware. Processor 302 and processor(s) 302' may each be a single core processor or multiple core (304 and 304') processor.

Virtualization may be employed in the computing device 300 so that infrastructure and resources in the computing device 300 may be shared dynamically. A virtual machine 314 may be provided to handle a process running on multiple processors so that the process appears to be using only one computing resource rather than multiple computing resources. Multiple virtual machines may also be used with one processor. Memory 306 may include a computer system memory or random access memory, such as DRAM, SRAM, EDO RAM, and the like. Memory 306 may include other types of memory as well, or combinations thereof.

A user may interact with the computing device 300 through a visual display device 318 (e.g., a personal computer, a mobile smart device, or the like), such as a computer monitor, which may display one or more user interfaces 320 (e.g., GUI 126) that may be provided in accordance with exemplary embodiments. The computing device 300 may include other I/O devices for receiving input from a user, for example, a keyboard or any suitable multi-point touch interface 308, a pointing device 310 (e.g., a mouse). The keyboard 308 and the pointing device 310 may be coupled to the visual display device 318. The computing device 300 may include other suitable conventional I/O peripherals.

The computing device 300 may also include one or more storage devices 324, such as a hard-drive, CD-ROM, or other computer readable media, for storing data and computer-readable instructions and/or software that implement exemplary embodiments of the system 100 described herein. Exemplary storage device 324 may also store one or more databases 326 for storing any suitable information required to implement exemplary embodiments. For example, exemplary storage device 324 can store one or more databases 326 for storing information, such as data relating to the user profiles 130 (weight limit 132, compliance 134, bag type 136), machine readable identifiers 114, item characteristics 116, standard bagging instructions, combinations thereof, or the like, and computer-readable instructions and/or software that implement exemplary embodiments described herein. The databases 326 may be updated by manually or automatically at any suitable time to add, delete, and/or update one or more items in the databases.

The computing device 300 can include a network interface 312 configured to interface via one or more network devices 322 with one or more networks, for example, Local Area Network (LAN), Wide Area Network (WAN) or the Internet through a variety of connections including, but not limited to, standard telephone lines, LAN or WAN links (for example, 802.11, T1, T3, 56 kb, X.25), broadband connections (for example, ISDN, Frame Relay, ATM), wireless connections, controller area network (CAN), or some combination of any or all of the above. The network interface 312 may include a built-in network adapter, network interface card, PCMCIA network card, card bus network adapter, wireless network adapter, USB network adapter, modem or any other device suitable for interfacing the computing device 300 to any type of network capable of communication and performing the operations described herein. Moreover, the computing device 300 may be any computer system, such as a workstation, desktop computer, server, laptop, handheld computer, tablet computer (e.g., the iPad™ tablet computer), mobile computing or communication device (e.g., the iPhone™ communication device), or other form of computing or telecommunications device that is capable of communication and that has sufficient processor power and memory capacity to perform the operations described herein.

The computing device 300 may run any operating system 316, such as any of the versions of the Microsoft® Windows® operating systems, the different releases of the Unix and Linux operating systems, any version of the MacOS® for Macintosh computers, any embedded operating system, any real-time operating system, any open source operating system, any proprietary operating system, or any other operating system capable of running on the computing device and performing the operations described herein. In exemplary embodiments, the operating system 316 may be run in native mode or emulated mode. In an exemplary embodiment, the operating system 316 may be run on one or more cloud machine instances.

Figure 4:
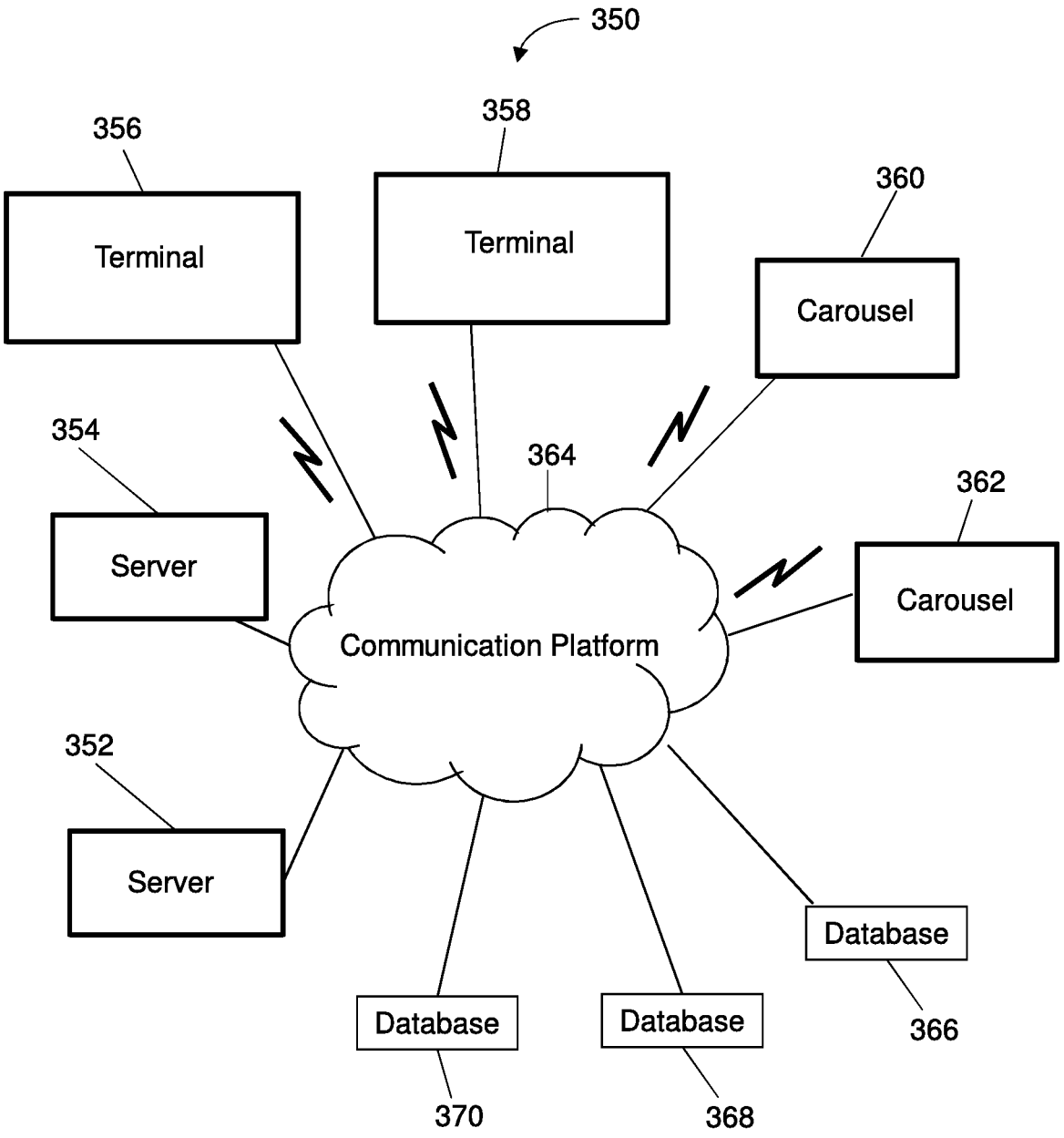
FIG. 4 is a block diagram of an exemplary item carousel system environment in accordance with embodiments of the present disclosure.

FIG. 4 is a block diagram of an exemplary item carousel system environment 350 in accordance with exemplary embodiments of the present disclosure. The environment 350 can include servers 352, 354 configured to be in communication with terminals 356, 358, and carousels 360, 362, via a communication platform 364, which can be any network over which information can be transmitted between devices communicatively coupled to the network. For example, the communication platform 364 can be the Internet, Intranet, virtual private network (VPN), wide area network (WAN), local area network (LAN), and the like. In some embodiments, the communication platform 364 can be part of a cloud environment. The environment 350 can include repositories or databases 366, 368, 370, which can be in communication with the servers 352, 354, as well as the terminals 356, 358, and carousels 360, 362, via the communications platform 364.

In exemplary embodiments, the servers 352, 354, terminals 356, 358, carousels 360, 362, and databases 366, 368, 370 can be implemented as computing devices (e.g., computing device 300). Those skilled in the art will recognize that the databases 366, 368, 370 can be incorporated into one or more of the servers 352, 354 such that one or more of the servers 352, 354 can include databases 366, 368, 370. In some embodiments, the database 366 can store the user profiles 130 and the database 368 can store the machine readable identifiers 114 and item characteristics 116. In some embodiments, the data from the preference database 128 and the item database 112 can be stored in a distributed manner over the databases 366, 368, 370.

Figure 5A:
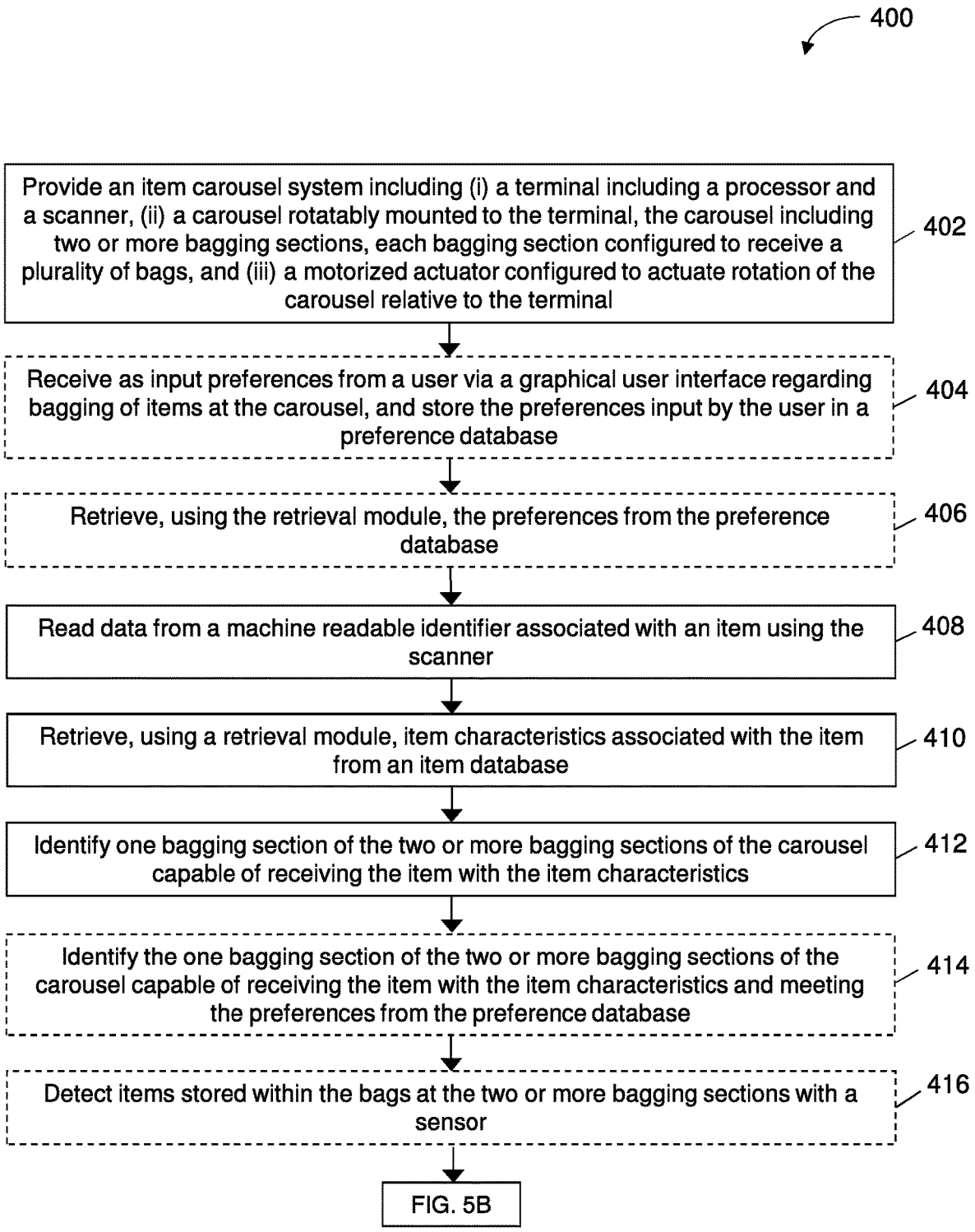
FIGS. 5A and 5B are a flowchart illustrating a process implemented by an exemplary item carousel system in accordance with embodiments of the present disclosure.
Figure 5B:
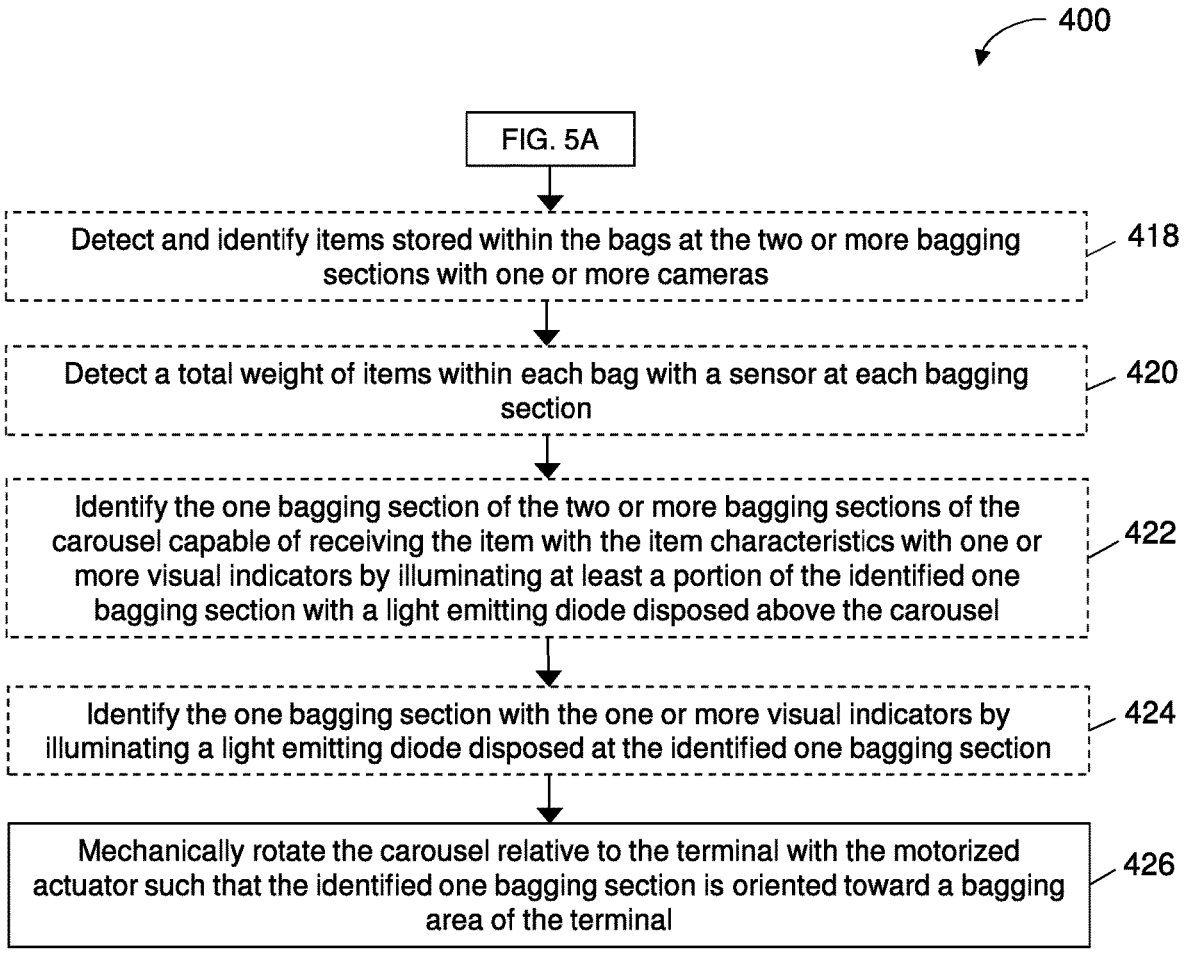

FIGS. 5A and 5B are a flowchart illustrating an exemplary process 400 as implemented by embodiments of the system 100. To begin, at step 402, an item carousel system is provided that includes the terminal, the carousel rotatably mounted to the terminal, and the motorized actuator for rotating the carousel. In some embodiments, at step 404, bagging preferences can be input by the user via a GUI and stored in a preference database. In some embodiments, at step 406, the bagging preferences specific to the user can be retrieved from the preference database prior to the item procurement process (e.g., by input of a unique user identifier into the GUI).

At step 408, data from a machine readable identifier associated with an item is read using the scanner of the terminal. At step 410, item characteristics associated with the item are retrieved using a retrieval module from an item database based on the scanned machine readable identifier. At step 412, one bagging section of the carousel is identified or selected as capable of receiving the item with the item characteristics. In some embodiments, at step 414, one bagging section of the carousel can be identified or selected as capable of receiving the item with the item characteristics based on meeting user preferences retrieved from the preference database. In some embodiments, at step 416, items stored within the bags at the bagging sections can be detected with one or more sensors to determine which bagging section should receive the scanned item (and/or to determine if items have been properly bagged).

In some embodiments, at step 418, items stored within the bags at the bagging sections can be detected and identified with one or more cameras via image and/or video analytics to determine which bagging section should receive the scanned item (and/or to determine if items have been properly bagged). In some embodiments, at step 420, the total weight of the items within each bag can be detected with a sensor located at each bagging section to determine which bagging section should receive the scanned item (and/or to determine if items have been properly bagged). In some embodiments, at step 422, the bagging section to receive the scanned item can be identified by illuminating the bagging section with a light emitting diode (e.g., a visual indicator) disposed above the carousel. In some embodiments, at step 422, the bagging section to receive the scanned item can be identified by illuminating a light emitting diode (e.g., a visual indicator) disposed at the corresponding bagging section. At step 426, the carousel is mechanically rotated relative to the terminal with the motorized actuator such that the identified or selected bagging section is oriented toward the bagging area of the terminal.

Thus, the exemplary item carousel system provides an efficient and accurate means for determining which bag should receive a scanned item. In particular, based on standard bagging instructions or user preferences, the system determines which bag should receive the item scanned at the terminal and automatically rotates the carousel in a motorized manner to orient the selected bagging section towards the bagging area. The user can therefore conveniently place the item within the bag facing the user without having to search for the bagging section that should receive the item, resulting in an efficient and accurate procurement process.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. An item carousel system, comprising:
a terminal including a processor and a scanner;
a carousel rotatably mounted to the terminal, the carousel including two or more bagging sections, each bagging section configured to receive a plurality of bags; and
a motorized actuator configured to actuate rotation of the carousel relative to the terminal;
wherein the terminal is configured to:
read data from a machine readable identifier associated with an item using the scanner;
retrieve, using a retrieval module, item characteristics associated with the item from an item database;
identify one bagging section of the two or more bagging sections of the carousel capable of receiving the item with the item characteristics;
mechanically rotate the carousel relative to the terminal with the motorized actuator such that the identified one bagging section is oriented toward a bagging area of the terminal; and
at least partially illuminate, with one or more visual indicators disposed above and remote from the carousel, the identified one bagging section of the carousel capable of receiving the item with the item characteristics.

2. The item carousel system of claim 1, comprising a graphical user interface configured to receive as input preferences from a user regarding bagging of items at the carousel, and comprising a preference database storing the preferences input by the user.

3. The item carousel system of claim 2, wherein the preferences include at least one of item compliance, bag weight limit, or bag type.

4. The item carousel system of claim 2, wherein the terminal is configured to:
retrieve, using the retrieval module, the preferences from the preference database; and
identify the one bagging section of the two or more bagging sections of the carousel capable of receiving the item with the item characteristics and meeting the preferences from the preference database.

5. The item carousel system of claim 1, wherein the one or more visual indicators are configured to follow and maintain the identified one bagging section at least partially illuminated during rotation of the carousel.

6. The item carousel system of claim 1, wherein the one or more visual indicators comprise a light emitting diode secured to a ceiling above the carousel and configured to illuminate at least a portion of the identified one bagging section.

7. The item carousel system of claim 1, wherein:

the one or more visual indicators comprise light emitting diodes disposed at each bagging section of the carousel; and after identification of the one bagging section capable of receiving the item, the terminal is configured to transmit a signal to an electric circuit to illuminate the light emitting diodes disposed at the identified one bagging section.

8. The item carousel system of claim 1, comprising a sensor configured to detect items stored within the bags at the two or more bagging sections.

9. The item carousel system of claim 1, comprising one or more cameras configured to detect and identify items stored within the bags at the two or more bagging sections.

10. The item carousel system of claim 1, comprising a sensor at each bagging section configured to detect a total weight of items within each bag.

11. The item carousel system of claim 1, wherein if two or more bagging sections of the carousel are capable of receiving the item with the item characteristics, the terminal is configured to mechanically rotate the carousel relative to the terminal with the motorized actuator such that the bagging section of the two or more identified bagging sections closest to the bagging area of the terminal is oriented toward the bagging area of the terminal.

12. A method of bagging items, comprising:

providing an item carousel system including (i) a terminal including a processor and a scanner, (ii) a carousel rotatably mounted to the terminal, the carousel including two or more bagging sections, each bagging section configured to receive a plurality of bags, (iii) a motorized actuator configured to actuate rotation of the carousel relative to the terminal, and (iv) one or more visual indicators;

reading data from a machine readable identifier associated with an item using the scanner;

retrieving, using a retrieval module, item characteristics associated with the item from an item database;

identifying one bagging section of the two or more bagging sections of the carousel capable of receiving the item with the item characteristics;

mechanically rotating the carousel relative to the terminal with the motorized actuator such that the identified one bagging section is oriented toward a bagging area of the terminal; and at least partially illuminating, with the one or more visual indicators disposed above and remote from the carousel, the identified one bagging section of the carousel capable of receiving the item with the item characteristics.

13. The method of claim 12, comprising receiving as input preferences from a user via a graphical user interface regarding bagging of items at the carousel, and comprising storing the preferences input by the user in a preference database.

14. The method of claim 13, comprising:

retrieving, using the retrieval module, the preferences from the preference database; and identifying the one bagging section of the two or more bagging sections of the carousel capable of receiving the item with the item characteristics and meeting the preferences from the preference database.

15. The method of claim 12, comprising identifying the one bagging section of the two or more bagging sections of the carousel capable of receiving the item with the item characteristics with the one or more visual indicators.

16. The method of claim 15, wherein at least partially illuminating the identified one bagging section comprises illuminating at least a portion of the identified one bagging section with a light emitting diode secured to a ceiling above the carousel.

17. The method of claim 15, wherein the carousel comprises light emitting diodes disposed at each bagging section.

18. The method of claim 17, wherein after identification of the one bagging section capable of receiving the item, the method comprises transmitting a signal to an electric circuit to illuminate the light emitting diodes disposed at the identified one bagging section.

19. The method of claim 12, comprising detecting items stored within the bags at the two or more bagging sections with a sensor.

20. A non-transitory computer-readable medium storing instructions for operating an item carousel system that are executable by a processor, the item carousel system including (i) a terminal including the processor and a scanner, (ii) a carousel rotatably mounted to the terminal, the carousel including two or more bagging sections, each bagging section configured to receive a plurality of bags, (iii) a motorized actuator configured to actuate rotation of the carousel relative to the terminal, and (iv) one or more visual indicators, wherein execution of the instructions by the processor causes the processor to:

read data from a machine readable identifier associated with an item using the scanner;

retrieve, using a retrieval module, item characteristics associated with the item from an item database;

identify one bagging section of the two or more bagging sections of the carousel capable of receiving the item with the item characteristics;

mechanically rotate the carousel relative to the terminal with the motorized actuator such that the identified one bagging section is oriented toward a bagging area of the terminal; and at least partially illuminate, with the one or more visual indicators disposed above and remote from the carousel, the identified one bagging section of the carousel capable of receiving the item with the item characteristics.

21. An item carousel system, comprising:

a terminal including a processor and a scanner;

a carousel rotatably mounted to the terminal, the carousel including two or more bagging sections, each bagging section configured to receive a plurality of bags; and a motorized actuator configured to actuate rotation of the carousel relative to the terminal;

wherein the terminal is configured to:

read data from a machine readable identifier associated with an item using the scanner;

retrieve, using a retrieval module, item characteristics associated with the item from an item database;

identify one bagging section of the two or more bagging sections of the carousel capable of receiving the item with the item characteristics;

mechanically rotate the carousel relative to the terminal with the motorized actuator such that the identified one bagging section is oriented toward a bagging area of the terminal; and at least partially illuminate, with one or more visual indicators, the identified one bagging section of the carousel capable of receiving the item with the item characteristics, the one or more visual indicators configured to follow and maintain the identified one bagging section at least partially illuminated during rotation of the carousel.

22. A method of bagging items, comprising:

providing an item carousel system including (i) a terminal including a processor and a scanner, (ii) a carousel rotatably mounted to the terminal, the carousel including two or more bagging sections, each bagging section configured to receive a plurality of bags, (iii) a motorized actuator configured to actuate rotation of the carousel relative to the terminal, and (iv) one or more visual indicators;

reading data from a machine readable identifier associated with an item using the scanner;

retrieving, using a retrieval module, item characteristics associated with the item from an item database;

identifying one bagging section of the two or more bagging sections of the carousel capable of receiving the item with the item characteristics;

mechanically rotating the carousel relative to the terminal with the motorized actuator such that the identified one bagging section is oriented toward a bagging area of the terminal;

at least partially illuminating, with the one or more visual indicators, the identified one bagging section of the carousel capable of receiving the item with the item characteristics; and following and maintaining the identified one bagging section at least partially illuminated with the one or more visual indicators during rotation of the carousel.

23. A non-transitory computer-readable medium storing instructions for operating an item carousel system that are executable by a processor, the item carousel system including (i) a terminal including the processor and a scanner, (ii) a carousel rotatably mounted to the terminal, the carousel including two or more bagging sections, each bagging section configured to receive a plurality of bags, (iii) a motorized actuator configured to actuate rotation of the carousel relative to the terminal, and (iv) one or more visual indicators, wherein execution of the instructions by the processor causes the processor to:

read data from a machine readable identifier associated with an item using the scanner;

retrieve, using a retrieval module, item characteristics associated with the item from an item database;

identify one bagging section of the two or more bagging sections of the carousel capable of receiving the item with the item characteristics;

mechanically rotate the carousel relative to the terminal with the motorized actuator such that the identified one bagging section is oriented toward a bagging area of the terminal;

at least partially illuminate, with the one or more visual indicators, the identified one bagging section of the carousel capable of receiving the item with the item characteristics; and follow and maintain the identified one bagging section at least partially illuminated with the one or more visual indicators during rotation of the carousel.

24. An item carousel system, comprising:

a terminal including a processor and a scanner;

a carousel rotatably mounted to the terminal, the carousel including bagging sections, each bagging section configured to receive a plurality of bags; and a motorized actuator configured to actuate rotation of the carousel relative to the terminal;

wherein the terminal is configured to:

read data from a machine readable identifier associated with an item using the scanner;

retrieve, using a retrieval module, item characteristics associated with the item from an item database;

identify two or more bagging sections of the carousel capable of receiving the item with the item characteristics;

mechanically rotate the carousel relative to the terminal with the motorized actuator such that the bagging section of the two or more identified bagging sections closest to a bagging area of the terminal is oriented toward the bagging area of the terminal; and at least partially illuminate, with one or more visual indicators, the bagging section of the carousel capable of receiving the item with the item characteristics and rotated to orient toward the bagging area of the terminal.

25. A method of bagging items, comprising:

providing an item carousel system including (i) a terminal including a processor and a scanner, (ii) a carousel rotatably mounted to the terminal, the carousel including two or more bagging sections, each bagging section configured to receive a plurality of bags, (iii) a motorized actuator configured to actuate rotation of the carousel relative to the terminal, and (iv) one or more visual indicators;

reading data from a machine readable identifier associated with an item using the scanner;

retrieving, using a retrieval module, item characteristics associated with the item from an item database;

identifying two or more bagging sections of the carousel capable of receiving the item with the item characteristics;

mechanically rotating the carousel relative to the terminal with the motorized actuator such that the bagging section of the two or more identified bagging sections closest to a bagging area of the terminal is oriented toward the bagging area of the terminal; and at least partially illuminating, with the one or more visual indicators, the bagging section of the carousel oriented toward the bagging area of the terminal, the bagging section of the carousel oriented toward the bagging area of the terminal capable of receiving the item with the item characteristics.

26. A non-transitory computer-readable medium storing instructions for operating an item carousel system that are executable by a processor, the item carousel system including (i) a terminal including the processor and a scanner, (ii) a carousel rotatably mounted to the terminal, the carousel including two or more bagging sections, each bagging section configured to receive a plurality of bags, (iii) a motorized actuator configured to actuate rotation of the carousel relative to the terminal, and (iv) one or more visual indicators, wherein execution of the instructions by the processor causes the processor to:

read data from a machine readable identifier associated with an item using the scanner;

retrieve, using a retrieval module, item characteristics associated with the item from an item database;

identify two or more bagging sections of the carousel capable of receiving the item with the item characteristics;

mechanically rotate the carousel relative to the terminal with the motorized actuator such that the bagging section of the two or more identified bagging sections closest to a bagging area of the terminal is oriented toward the bagging area of the terminal; and at least partially illuminate, with the one or more visual indicators, the bagging section of the carousel oriented toward the bagging area of the terminal, the bagging section oriented toward the bagging area of the terminal capable of receiving the item with the item characteristics.

* * * * *